United States Patent [19]

Lo Giudice

[11] 4,070,777

[45] Jan. 31, 1978

[54] BUBBLER DISPLAY DEVICE AND METHOD OF MAKING SAME

[76] Inventor: Joseph C. Lo Giudice, 5400 W. Montrose Ave., Chicago, Ill. 60641

[21] Appl. No.: 728,040

[22] Filed: Sept. 30, 1976

[51] Int. Cl.[2] ..... G09F 13/24

[52] U.S. Cl. ..... 40/406; 362/92; 362/101; 362/806

[58] Field of Search ..... 40/106.21, 106.22, 106.23; 240/10 A, 10 T, 10 R; 272/15

[56] References Cited

U.S. PATENT DOCUMENTS

| | | | |
|---|---|---|---|
| 2,383,941 | 9/1945 | Otis | 240/10 A X |
| 2,520,691 | 8/1950 | Otis | 240/10 A X |
| 2,741,693 | 4/1956 | Fasson | 40/106.21 |
| 3,499,238 | 3/1970 | Publicker | 40/106.21 |
| 3,755,663 | 8/1973 | George | 240/10 R |
| 3,903,628 | 9/1975 | Goyeau | 40/106.21 |

*Primary Examiner*—John F. Pitrelli

[57] ABSTRACT

A display device for generating bubbles, which may be illuminated, passing through a body of fluid, including a sealed translucent hollow glass tube partially filled with fluid of a low boiling point and evacuated of air, a chamber of a diameter less than that of the tube secured to the bottom end of the tube, and a heat source associated with the chamber. In one embodiment of the invention the chamber consists of a mass of agglomerated prismatic particles bonded to the bottom of the tube. In another embodiment of the invention, the chamber consists of a closed glass tube having a heater therein which is open on one end for discharge of bubbles into the sealed tube. The invention also includes the method for making such a bubbler device.

10 Claims, 10 Drawing Figures

Fig. 5
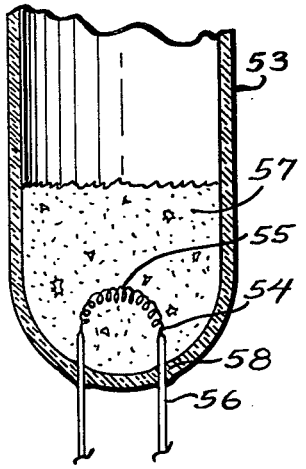
Fig. 6
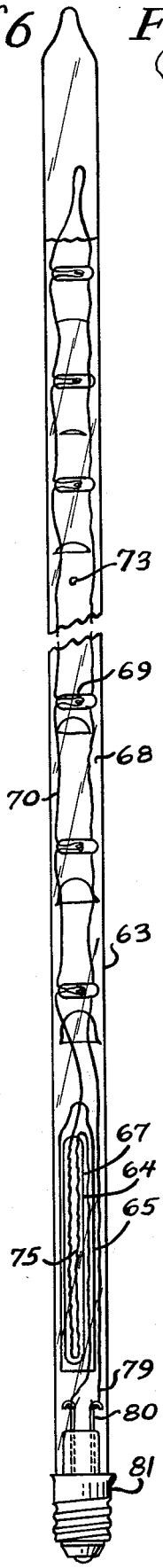
Fig. 7
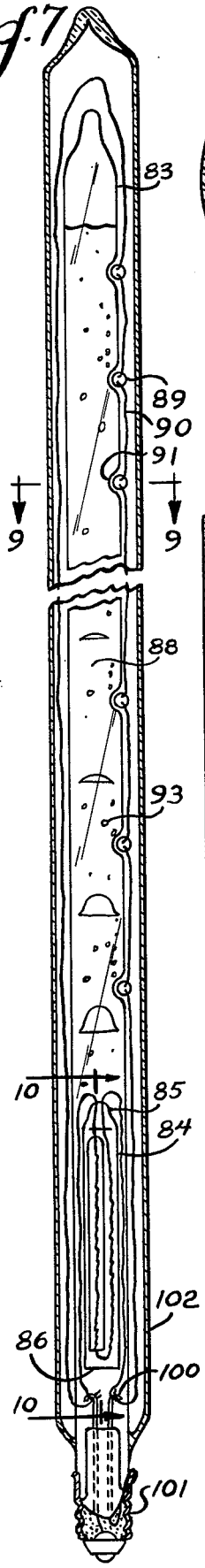
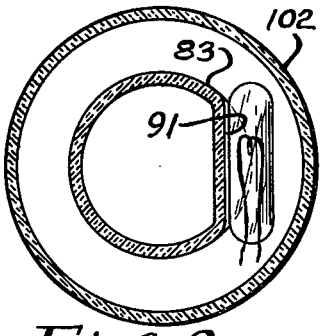
Fig. 9
Fig. 8
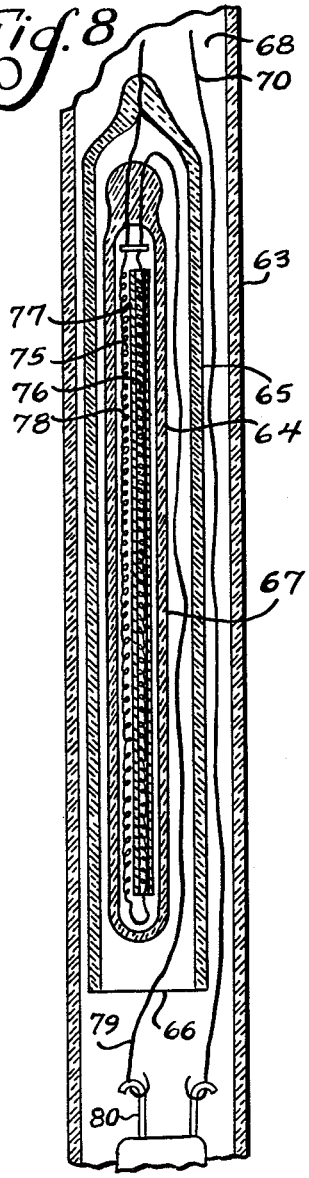
Fig. 10
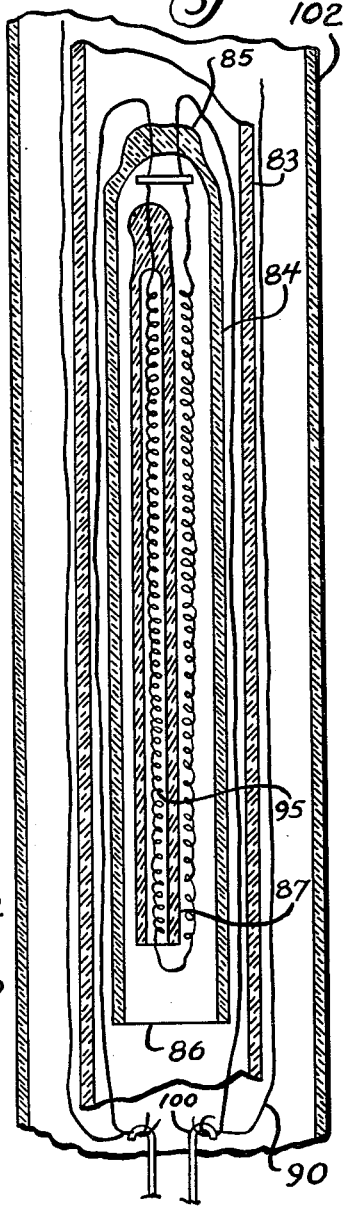

BUBBLER DISPLAY DEVICE AND METHOD OF MAKING SAME

This invention relates to bubbler display devices which may be used for advertising devices, ornaments and novelty lamps. The invention is more particularly concerned with displays of the character referred to, which may be illuminated, and which provide quick and continuous generation and discharge of bubbles passing through a body of fluid, and is also concerned with a method for making such displays.

Conventional displays of effervescent liquids utilize a bubbler tube having a lower gas chamber and an upper expansion chamber connected by a body of liquid, the tube being evacuated of air, wherein heat is applied to the gas chamber and bubbles are formed in the low boiling point liquid in the tube to escape upwardly through the liquid into the expansion chamber. However, such conventional devices usually require a warm-up period so that the bubbles are not generated until after the chamber is of a temperature elevated above that of the liquid and expansion chamber, or the bubble flow is not continuous, or bubble formation means which blocks efficient optical transmission are used.

A display embodying the present invention not only quickly and consistently and continuously creates and discharges bubbles of a desired size and shape, but also can be efficiently illuminated for maximum optical effect with conventional illumination means, without increasing the size or difficulty or expense in fabricating the bubbler tube. In one embodiment of the present invention, a cellular mass of agglomerated prismatic particles is bonded to the bottom of the tube and a heat source is embedded in the mass, or a lamp in radiating proximity to the mass may be utilized to generate heat. In another embodiment a gas chamber comprised of a tube closed at one end with a heating element in the tube may be secured to the bottom of the bubbler tube. The bubbler tube may be illuminated, by disposing a lamp benesth the tube, or stringing minature lights within or to the side of the tube, or by encasing the bubbler tube in an outer shell which may contain neon or similar gas or lamp bulbs for illumination.

Fabrication of the novel bubbler tube having agglomerated glass particles is accomplished by placing ground glass particles into the open end of a closed tube where they settle on the closed end, and by firing the closed tube end for a few seconds to cause the glass particles to agglomerate, whereupon the tube is filled with low boiling point liquid, leaving a space above the liquid, the tube is evacuated of air and the open end is then sealed. A resistance wire winding may be installed in the ground mass before firing, as to embed the same therein, and the wire connected to a source of power, whereupon it may function as a heating element for elevating the temperature within the prismatic chamber causing quick and continuous generation of bubbles therein.

Fabrication of the novel bubbler tube having an internal heated glass chamber is accomplished by placing a small glass tube closed at one end and having a winding of resistance wire therein into a longer glass tube of greater diameter than the small tube, and securing the small tube at one end of the long tube, whereupon the tube is filled with low boiling point liquid, leaving a space above the liquid, evacuated of air and sealed, the ends of the winding having been extended out of the large tube for connection to a source of power. The large or bubbler tube may be illuminated by installing a string of minature lamps within the large tube before the filling step, or by installing such lamps on the outside of the tube (as by inserting same in pockets formed in the outer tube wall), or by inserting the bubbler tube into a tube filled with neon or other gas, or by applying a lamp to the bottom of the tube.

OBJECTS OF THE INVENTION

It is the object of the invention to provide a novel bubbler display device of the character referred to which will quickly, consistently and continuously generate bubbles.

Another object of the invention is to provide a novel bubbler tube for an effervescent display.

Another object is to provide a novel clear chamber for and within a bubbler type.

Another object is to provide a novel cellular mass of agglomerated prismatic particles bonded to the bottom of a bubbler type.

Another object is to provide a novel glass gas chamber for a bubbler type.

Another object is to provide novel internal heater means for a clear gas chamber within a bubbler tube.

Another object is to provide a method for making an effervescent display which includes the novel steps of installing a glass gas chamber within and at one end of a bubbler tube, partially filling the tube with low boiling point liquid, evacuating the tube of air, and sealing the evacuated tube.

With the foregoing and other objects in mind, which may appear as this description proceeds, reference is made to the accompanying drawings.

BRIEF DESCRIPTION OF THE DRAWINGS

In the drawings:

FIG. 5 is a view similar to FIG. 3 showing a modified embodiment with a heater in its gas chamber.

FIG. 6 is an elevational view of another embodiment of the invention.

FIG. 7 is an elevational view of another embodiment of the invention, partially in section.

FIG. 8 is an enlarged sectional detail view showing the heater-gas chamber of the FIG. 6 embodiment.

FIG. 9 is an enlarged cross-sectional detail view taken on line 9 — 9 of FIG. 7.

FIG. 10 is an enlarged sectional detail view taken on line 10 — 10 of FIG. 7.

DESCRIPTION OF A PREFERRED EMBODIMENT

Figure 1:
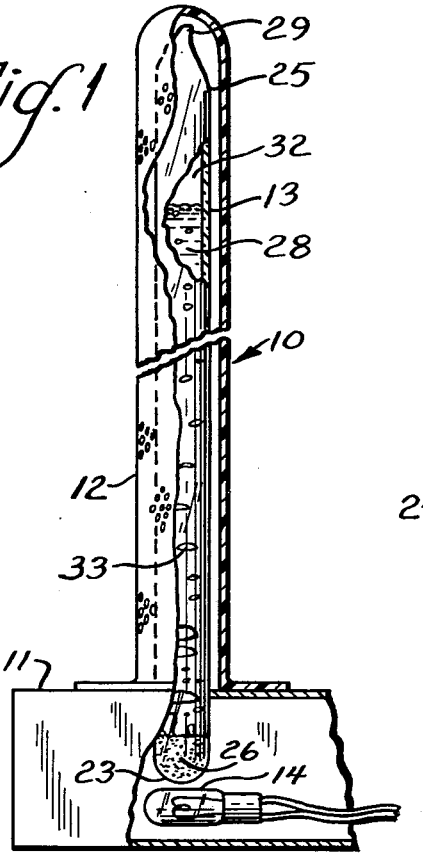
FIG. 1 is an elevational view of an illuminated bubbler display device embodying the invention, parts being broken away to show the bubbler tube and a light-heat source.
Figure 2:
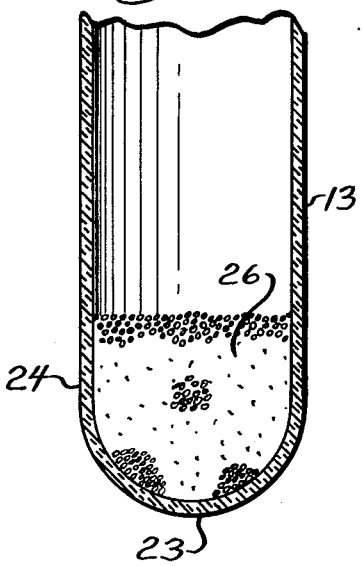
FIG. 2 is an elevational view showing the lower end of the tube shown in FIG. 1 during fabrication thereof.
Figure 3:
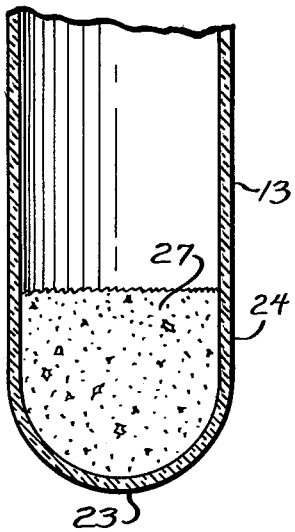
FIG. 3 is an elevational view similar to FIG. 2, except the glass particles therein have been agglomerated.
Figure 4:
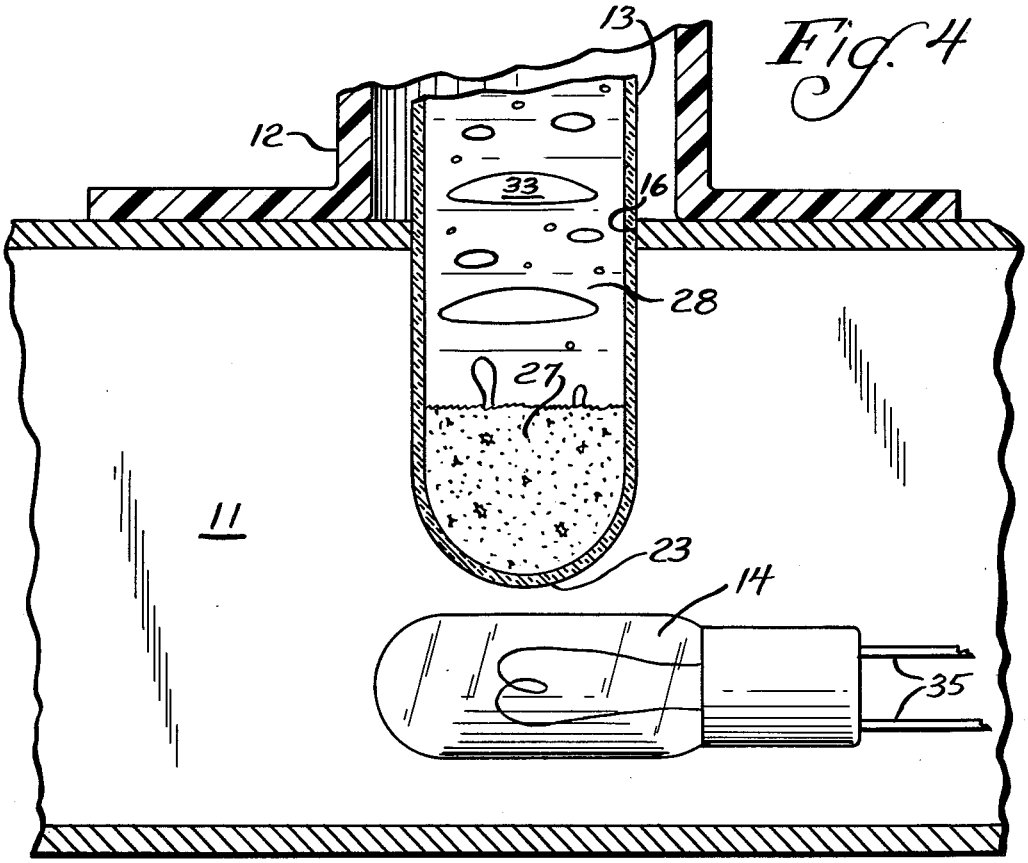
FIG. 4 is an enlarged sectional view of part of the device shown in FIG. 1.

With reference to the accompanying drawings and particularly to the embodiment shown in FIGS. 1 – 4, the display device 10 has a housing 11 or base, and a tube housing 12 mounted on the base, the tube housing being transparent to reveal at least a portion of a bubbler tube 13, through which heat may be generated and light may be beamed from a conventional heat-light source 14, such as a light bulb.

Preferably, the lamp base 11 has an aperture 16 through which the tube 13 extends, so that the tube bottom 23 and the heat-light source 14 are shielded from view and light may pass upwardly only through the tube.

The bubbler tube 13, preferably fabricated from glass, has a closed bottom 23 and a cylindrical wall 24. During fabrication the upper end 25 of the tube is open, and glass particles 26 are placed into the open tube, where they settle on the bottom 23. Heat, preferably from a bunsen burner or torch, is applied for a few seconds (usually not more than 10 seconds) to the tube bottom 23 and the lower portion of wall 24, until the glass particles 26 just begin to melt, causing the particles to agglomerate into a cellular mass 27. The heat also causes the particles to become transparent and prismatic, and the agglomerated cellular mass is bonded to the bottom 23 and wall 24 of the tube 13. Excessive heat causes the particles to flow into a unified mass, without open cells for the formation and discharge of bubbles, as hereinafter described. Inadequate heat prevents the cellular mass from agglomerating or bonding to the tube wall or from allowing the normally semi-opaque white-like particles from becoming transparent and prismatic.

Liquid 28 having a low boiling point, preferably methylene chloride or other non-flamable liquid of low boiling point, is poured into the upper end 25 of the tube 13, until the tube is about 75% filled. Preferably, the liquid 28 is cooled by immersion in liquid nitrogen or the like, so that its gases are dormant. The tube 13 is then evacuated of air by applying a vacuum pump to the open tube end 25, whereupon the tube apex 29 is tipped off and sealed, by application of heat to the apex. When the tube 13 is positioned with the apex 29 up and the bottom 23 down, an expansion chamber 32 is formed above the level of the liquid 28.

Bubbles 33 are consistently and continuously formed in the gas chamber defined by the cellular mass 27 when heat is applied to the tube bottom 23, and the bubbles are released from the gas chamber 27 and rise through the liquid 28 into the expansion chamber 32. Because the gas chamber is clear and prismatic, light may be optically beamed from the bulb 14 through the mass and liquid 28 to illuminate the bubbles 33 as they rise through the liquid. The bulb 14 may be powered by any convenient electrical source through leads 35. The liquid 28, gas chamber 27 and tube bottom 23 are preferably translucent to permit transmission of light, although they may be tinted to impart a colored effect to the display. Bubble size may be varied by varying the size of the cell openings in the gas chamber. The speed of bubble discharge may be slowed by adding motor oil or other oils or solvents to the liquid 28.

MODIFIED EMBODIMENTS

With reference to the modification shown in FIG. 5, wherein the bubbler device shown is constructed substantially similar to the embodiment shown in FIGS. 1 – 4, the modified bubbler tube 53 has an electric heater 54, comprised on a winding 55 of resistance wire and suitable electric leads 56, which is sealed in the gas chamber 57 and connected to a source of electric power through the bottom wall 58 of the tube.

In the embodiment disclosed in FIGS. 6 and 8, an electric heater assembly 64 is secured in the bubbler tube 63, which is filled with low boiling point liquid 68 and evacuated of air in the manner described with reference to FIGS. 1–4. Minature lamps 69 may be connected by a wire 70 and strung in the tube to illuminate bubbles 73 rising through the liquid. Preferably, the electric heater assembly 64 may comprise a glass tube 65 open at one end 66 having therein a closed glass heater tube 67, within which is a winding 75 of electric resistance wire one leg 76 thereof being contained in a small inner glass tube 77 to insulate it from the other leg 78, and lead wire 79 extending therefrom. The heater and lamp wires 70 and 79 may be connected to a terminal 80 constituting part of a conventional threaded lamp base 81 which seals the bubbler tube 63 and connects the heater and lamps to a source of electric power.

The modified bubbler display device disclosed in FIGS. 7, 9 and 10, comprises a bubbler tube 83 in which is secured an electric heater assembly 84, filled with low boiling point liquid 88 and evacuated of air and sealed in the manner previously described. Minature lamps 89 for illuminating the bubbling tube may be connected together by wire 90 and secured in pockets 91 formed in the exterior of the bubbler tube 83, and the pockets may project into the tube to break up and vary the path of bubbles 93 rising therein. In this modification, the electric heater assembly 84 comprises a glass tube 85 open at one end 86 having therein an open glass heater tube 87 within which is a winding 95 of electric resistance wire. The heater and lamp wires 90 and 99 may be connected together to terminal 100 and secured to a lamp base 101, and the bubbler tube 83 may be telescoped and secured within an outer tube 102. The outer tube 102 may also be secured to the base 101 and may be filled with neon or other gas or liquid to vary the optical effect of the display.

Displays embodying the invention may be made in a variety of sizes and shapes. They may be encased in a tube housing, as shown with respect to the FIG. 1–4 embodiment, or they may be formed integrally with a lamp base, as shown in FIGS. 6 and 7, and the tube or its housing may be decorated.

As many possible embodiments may be made of the invention, and as many changes may be made in the illustrated embodiments, it is to be understood that the disclosure is intended to be illustrative and not limiting of the invention. Having thus described the invention, what is claimed as new and desired to be secured by Letters Patent is the following:

I claim:

1. A display device for generating a continuous flow of bubbles through a body of liquid, said device comprising, an elongated vertically disposed transparent tube evacuated of air, a translucent glass chamber arranged at the lower end of and within said tube, said chamber being closed at its upper end and open at its lower end, a body of liquid in the tube covering and extending above said chamber, some of said liquid entering the lower end of said chamber, electric heater means within said chamber for heating liquid entering thereinto and discharging gaseous bubbles therefrom into the transparent tube and wire means supporting said heater and chamber within said tube.

2. The display device recited in claim 1, wherein said chamber is of lesser diameter than said elongated tube.

3. The display device recited in claim 2, wherein said heater means comprises an electric heating element within said chamber.

4. The display device recited in claim 3, wherein said heating element is housed within a closed tube enclosed within said chamber.

5. The display device recited in claim 1, wherein said heater means comprises a closed ended tube within said chamber.

6. The display device recited in claim 1, wherein spaced apart lamps are arranged in the liquid.

7. The display device recited in claim 6, wherein said wires connect the lamps in series with each other and with the heater.

8. In a method for making a bubbler display device comprising the steps of forming a gas chamber having a closed upper end and an open lower end inside the lower end of and in communication with an elongated bubbler tube, providing a heating element within said gas chamber, supporting said chamber and heating element by wires within said tube, filling the elongated tube with liquid of a quantity to immerse said gas chamber and heating element in said liquid and provide a body of said liquid above said gas chamber, providing a space within said tube devoid of liquid, evacuating air from and sealing said tube, and placing the heater element in heating proximity to said gas chamber to gasify said liquid and discharge gaseous bubbles therefrom.

9. In the method recited in claim 8, wherein said gas chamber is formed by arranging a closed ended tube within said elongated tube.

10. In the method recited in claim 9, wherein said heater means is formed by arranging an electric heater within said gas chamber.

* * * * *